US007354252B2

(12) United States Patent
Baatrup et al.

(10) Patent No.: US 7,354,252 B2
(45) Date of Patent: Apr. 8, 2008

(54) PRESSURE INTENSIFIER

(75) Inventors: Johannes V. Baatrup, Soenderborg (DK); Christen Esperson, Augustenborg (DK)

(73) Assignee: miniBooster Hydraulics A/S, Sonderborg (DK)

( * ) Notice: Subject to any disclaimer, the term of this patent is extended or adjusted under 35 U.S.C. 154(b) by 656 days.

(21) Appl. No.: 10/691,110

(22) Filed: Oct. 22, 2003

(65) Prior Publication Data

US 2004/0115070 A1 Jun. 17, 2004

(30) Foreign Application Priority Data

Oct. 23, 2002 (DE) ..... 102 49 523

(51) Int. Cl.
*F15B 3/00* (2006.01)

(52) U.S. Cl. ..... 417/245; 417/403

(58) Field of Classification Search ..... 417/225, 417/403, 545

See application file for complete search history.

(56) References Cited

U.S. PATENT DOCUMENTS 2,864,313 A * 12/1958 Dawson ..... 417/225
4,601,642 A * 7/1986 Andrews ..... 417/225
4,659,294 A * 4/1987 Barthomeuf ..... 417/397
5,170,691 A * 12/1992 Baatrup ..... 91/287
5,379,679 A * 1/1995 Falter et al. ..... 91/424
5,556,262 A * 9/1996 Achten et al. ..... 417/364
6,183,217 B1 * 2/2001 Elliott et al. ..... 417/403
6,295,914 B1 * 10/2001 Iversen ..... 91/300
6,712,587 B2 * 3/2004 Gerhardt et al. ..... 417/390
6,776,080 B2 * 8/2004 Hansen et al. ..... 91/300
6,938,610 B2 * 9/2005 Braun et al. ..... 123/446

FOREIGN PATENT DOCUMENTS

DE 196 33 258 C1 8/1997
DE 101 58 178 7/2003

* cited by examiner

*Primary Examiner*—Devon C. Kramer
*Assistant Examiner*—Leonard J Weinstein
(74) *Attorney, Agent, or Firm*—Friedrich Kueffner

(57) ABSTRACT

A pressure intensifier for fluids has an intensifier piston with a high-pressure piston and a low-pressure piston having a greater diameter than the high-pressure piston. The pistons are moveable in a high-pressure cylinder and a low-pressure cylinder, respectively, and move together. The high-pressure cylinder is connected to a high-pressure connection. A first control line is connected to a supply connector. A second control line is connected to a control valve having first and second switching positions. A first connection connects the control lines. The low-pressure cylinder is connected via the control valve in the first switching position to a supply connector and in the second switching position to a return connector. The switching positions are controlled by the intensifier piston. The intensifier piston opens or closes the first connection between the control lines. The first connection is arranged completely within a movement stroke of the high-pressure piston.

9 Claims, 1 Drawing Sheet

PRESSURE INTENSIFIER

BACKGROUND OF THE INVENTION

1. Field of the Invention

The invention relates to a pressure intensifier for fluids, in particular, for hydraulic liquids, comprising an intensifier piston comprising a high-pressure piston and a low-pressure piston having a greater diameter than the high-pressure piston, wherein the intensifier piston is movable together with the high-pressure piston in a high-pressure cylinder and together with the low-pressure piston in a low-pressure cylinder, wherein the high-pressure cylinder is connectable to a high-pressure connector and the low-pressure cylinder via a control valve, in a first switching position of the control valve, to a supply connector and, in a second switching position of the control valve, to a return connector, and wherein the switching positions of the control valve are controlled by the position of the intensifier piston, wherein the intensifier piston releases or interrupts a connection between a first control line connected to the supply connector and a second control line connected to the control valve.

2. Description of the Related Art

Such a pressure intensifier is known, for example, from DE 196 33 258 C1. The control valve guides the hydraulic liquid under pressure into the low-pressure cylinder and loads thus the low-pressure piston. The low-pressure piston moves in the low-pressure cylinder and thus drives the high-pressure piston that issues hydraulic liquid at a correspondingly higher pressure at the high-pressure connector. After a certain movement travel, the high-pressure piston closes the second control line that opens into the wall of the high-pressure cylinder. In this way, the corresponding control connector of the control valve is relieved of pressure, and the control valve switches so that the hydraulic liquid can escape from the low-pressure cylinder.

However, the known device requires that the fluid that is used by the drive of the pressure intensifier is the same fluid that also issues at higher pressure.

SUMMARY OF THE INVENTION

It is an object of the present invention to enable a more flexible operation of the pressure intensifier.

In accordance with the present invention, this is achieved in that the connection is arranged entirely within the movement stroke of the high-pressure piston.

In this way, it is possible to employ a fluid for driving the pressure intensifier that is completely separate from the pumping fluid that is to be pressurized by the pressure intensifier to the higher pressure. The separation between driving fluid and pumping fluid is realized by means of the high-pressure piston. The high-pressure piston must be sealed relatively tightly anyway within the high-pressure cylinder so that the pressure intensifier obtains the desired inner seal-tightness and thus the desired high efficiency. In comparison to the known device, only relatively minimal modifications are possible in order to decouple the two fluids.

Preferably, the two control lines open into the wall of the high-pressure cylinder in an area that is located outside of the high-pressure chamber that is delimited by the high-pressure cylinder and the high-pressure piston, independently of the position of the intensifier piston. Accordingly, in the high-pressure chamber pumping fluid is exclusively present. This pumping fluid does not come into contact with the driving fluid. The high-pressure piston can cover or release the opening of the two control lines during the course of a working stroke. In this way, the connection between the two control lines is effected or interrupted.

Preferably, the high-pressure piston has a recess that, in a predetermined position of the intensifier piston, overlaps the openings of the two control lines. By means of this recess, the connection between the two control lines is thus realized. When the high-pressure piston is then moved by a corresponding amount, at least one opening of the two control lines is covered by the high-pressure piston so that the connection between the two control lines is interrupted.

Preferably, the recess is an annular chamber. In this way, the angular orientation of the high-pressure piston in the high-pressure cylinder is of no consequence. The annular chamber, for example, an annular groove, is able in all angle positions of the high-pressure piston to establish a connection between the two control lines.

Preferably, between the recess and the high-pressure chamber a seal arrangement comprising a leakage drainage line is provided. The seal arrangement seals initially the high-pressure chamber relative to the parts of the pressure intensifier that are filled with or communicate with another fluid. However, it is generally not possible to make such a seal arrangement completely seal-tight. Small amounts of fluid that can penetrate in the form of leakage into the space between the high-pressure piston and the high-pressure cylinder are drained by means of the leakage drainage line.

Preferably, the control valve is connected to the return connector by a path which extends in an area between the high-pressure piston and the low-pressure piston through the low-pressure cylinder. In this way, the area between the high-pressure piston and the low-pressure piston is filled with fluid that is displaced from the low-pressure chamber delimited by the low-pressure cylinder and the low-pressure piston. Cavitation phenomena can be prevented. When the low-pressure piston is moved such that the high-pressure chamber is enlarged, then the chamber between the high-pressure piston and the low-pressure piston is also enlarged, i.e., the space within the low-pressure cylinder. This chamber can then be refilled via the control valve.

Preferably, the low-pressure piston has at the periphery of at least one end face a circumferentially extending recess, and a correlated connection between the control valve and the low-pressure cylinder opens into the circumferential wall of the low-pressure cylinder in the area of its end face. In this way, the low-pressure piston can be reciprocated up to the stop position within the low-pressure cylinder. However, a driving action by means of a fluid is still possible even when this fluid is not introduced at the end face into the low-pressure cylinder but via the peripheral wall. The fluid then reaches the recess and can flow farther from there.

Preferably, a throttled auxiliary control path is arranged between the supply connector and control connector of the control valve and enables switching of the control valve into the first switching position. The auxiliary control path enables reliable starting of the pressure intensifier even after an extended downtime. The control valve has in fact always a defined switching position when it is pressurized.

In this connection, it is particularly preferred that the auxiliary control path is arranged in a valve element of the control valve. It is then possible to ensure that the auxiliary control path is interrupted when the control valve is in the second switching position.

DESCRIPTION OF THE PREFERRED EMBODIMENTS

Figure 1:
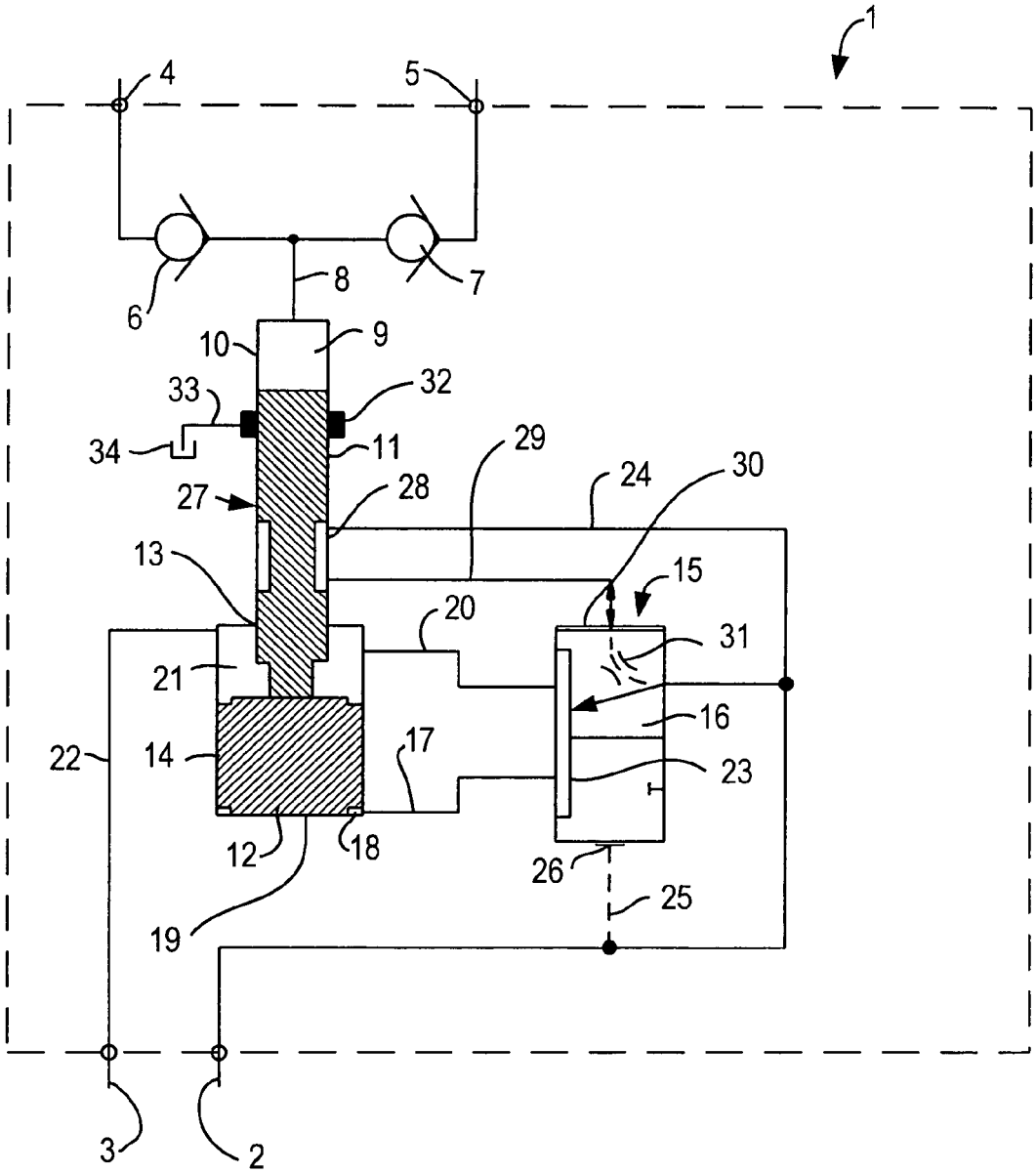
FIG. 1 is a schematic illustration of a pressure intensifier.

A pressure intensifier 1 has a supply connector 2 via which a driving fluid, for example, a first hydraulic liquid at a certain pressure, is supplied. This hydraulic liquid can be returned via a return connector 3. For example, the supply connector 2 can be connected to a pump, not illustrated in detail, and the return connector 3 to a tank, not illustrated in detail.

Moreover, the pressure intensifier 1 has a high-pressure outlet 4 and a high-pressure inlet 5, both connected to a high-pressure circuit in which a second hydraulic liquid circulates. The second hydraulic liquid, referred to in the following as the pumping liquid, is at a higher pressure than the first hydraulic liquid that is referred to as the driving liquid. It is desired to prevent that the driving liquid and the pumping liquid mix with one another. The pumping liquid is circulated via the high-pressure inlet 5 and the high-pressure outlet 4.

Between the high-pressure inlet 5 and the high-pressure outlet 4 two check valves 6, 7 are connected in series; the check valves 6, 7 open in the direction toward the high-pressure outlet 4. Between the two check valves 6, 7 a connection 8 branches off to the high-pressure chamber 9. The high-pressure chamber 9 is delimited by a high-pressure cylinder 10 and a high-pressure piston 11. The high-pressure piston 11 is connected to the low-pressure piston 12 wherein it is sufficient when a connection 13 between the high-pressure piston 11 and the low-pressure piston 12 can transmit pressure forces. For this reason, the high-pressure piston 11 and the low-pressure piston 12 are illustrated in the drawing as separate parts which rest against one another at the connection 13. The high-pressure piston 11 and low-pressure piston 12 together form a pressure intensifier piston 27 embodied as a differential piston.

The low-pressure piston 12 is movable in the low-pressure cylinder 14, wherein the movements of the high-pressure piston 11 and the low-pressure piston 12 occur together.

For controlling the movements of the high-pressure piston 11 and the low-pressure piston 12, a control valve 15 is provided which has a valve element 16 that can be moved between two switching positions.

In the first switching position of the valve element 16, the control valve 15 connects the supply connector 2 to the low-pressure cylinder 14, in particular, to the end of the low-pressure cylinder 14 facing away from the high-pressure piston 11. For this purpose, a line 17 between the control valve 15 and the peripheral wall of the low-pressure cylinder 14 is provided. This line 17 opens at a location where the low-pressure piston 12 has a circumferentially extending recess 18. Even though the driving liquid is supplied into the peripheral wall of the low-pressure cylinder 14 and the low-pressure piston 12 rest against the end face 19 of the low-pressure cylinder 14, the pressure loading achieved with the working liquid supplied via the line 17 is sufficient in order to move the low-pressure piston 12, in particular, upwardly, in relation to the illustration in the Figure.

The control valve 15 is connected by line 20 with a chamber 21 between the high-pressure piston 11 and the low-pressure piston 12 within the low-pressure cylinder 14. This chamber 21 is connected by line 22 to the return connector 3. In the second switching position of the switching valve 15, a connection between the two lines 17, 20 is realized via a connecting path 23, schematically illustrated in the valve element 16, so that the hydraulic liquid can return from the side of the low-pressure cylinder 14 facing away from the high-pressure piston 11 via the control valve 15 and the line 20, the chamber 21, and the line 22 to the return connector 3. Via the lines 17, 20, the liquid is displaced from the low-pressure chamber delimited by the low-pressure piston 12 and the low-pressure cylinder 14 into the chamber 21 so that it is not necessary that the entire driving liquid must be returned to the return connector 3. The liquid in the chamber 21 is however displaced to the return connector 3 upon an upward stroke of the low-pressure piston 12.

The valve element 16 of the control valve 15 is actuated by the pressure of the supply connector 2. The supply connector 2 is connected to a first control line 24. From the first control line 24 a branch line 25 branches off to the pressure chamber 26; the pressure chamber 26 has a small pressure action surface that acts on the valve element 16. A constant force acts via the pressure action surface on the valve element 16 and has the tendency to switch the control valve 15 into the second switching position.

The first control line 24 opens in the wall of the high-pressure cylinder 10 at a location that, independent of the position of the high-pressure piston 11, is covered by the high-pressure piston 11. The high-pressure piston 11 has at this location a circumferential groove 28 which has such a size that, in the illustrated position of the high-pressure piston 11, i.e., in the lower end position, it covers also a second control line 29 that is connected to a greater pressure action surface 30 on the valve elements 16. The pressure on the pressure action surface 30 thus has the tendency to switch the switching valve into the first switching position illustrated in the Figure. Since the pressure action surface 30 is greater than the pressure action surface 26, the control valve 15 is switched as soon as the groove 28 connects the two control lines 24, 29 to one another.

A throttled auxiliary control path 31 is provided in the valve element 16 which connects the first control line 24 and thus the supply connector 2 to the greater pressure action surface 30. When the pressure intensifier has been inoperative for some time, the valve element 16 is in the position illustrated in the Figure so that starting of the pressure intensifier is possible without problems anytime.

The pressure intensifier operates as follows: In the position illustrated in the Figure, the working fluid reaches via the switching valve 15 and the line 17 the low-pressure cylinder 14. in this connection, the low-pressure piston 12 is moved upwardly (all directional information relates to the illustration in the drawing). The high-pressure piston 11 is therefore moved such that the high-pressure chamber 9 becomes smaller. Pumping liquid issues via the check valve 6 and the high-pressure outlet 4.

After a certain movement travel of the high-pressure piston 11, the second control line 29 is closed. Accordingly, no pressure acts any longer on the larger pressure action surface 30; instead, only the pressure from the supply connector 2 acts on the smaller pressure action surface 26 so that the switching valve 15 is switched. The valve element 16 is moved into the other switching position. In this connection, it should be noted that the concrete configuration of the control valve 15 is of secondary importance for the present situation. The valve element 16 can be configured as a monolithic part or can be comprised of several parts. The drawing is thus to be understood to be only a schematic illustration.

When the control valve 15 is switched, the low-pressure piston 14, more precisely, the low-pressure chamber formed within the low-pressure piston 14 between the low-pressure piston 12 and the end face 19 of the low-pressure cylinder 14, is connected via the connecting path 23 to the chamber 21 and thus to the return connector 3. The pressure in the connection 8, which corresponds at least to the pressure at the high-pressure inlet 5, forces the high-pressure piston 11 downwardly. In this way, the low-pressure piston 12 is also moved downwardly. After a certain movement travel that is designed such that the low-pressure piston 12 is almost at the end of its movement path, the groove 28 of the high-pressure piston opens the opening of the second control line 29 so that pressure reaches again the greater pressure action surface 30 and the control valve 15 is switched.

The process is then repeated.

Between the high-pressure chamber 9 and the recess 28 a seal arrangement 32 is provided which has a leakage drainage line 33 connected to the tank 34. Since there is a certain risk that, via the leakage drainage line 33, the pumping liquid as well as the driving liquid can drain, the tank 34 is expediently separate from the return connector 3.

While specific embodiments of the invention have been shown and described in detail to illustrate the inventive principles, it will be understood that the invention may be embodied otherwise without departing from such principles.

What is claimed is:

1. A pressure intensifier for fluids comprising:

an intensifier piston comprising a high-pressure piston and a low-pressure piston having a greater diameter than the high-pressure piston;

a high-pressure cylinder, wherein the high-pressure piston is moveably arranged in the high-pressure cylinder;

a low-pressure cylinder, wherein the low-pressure piston is moveably arranged in the low-pressure cylinder and wherein the high-pressure piston and the low-pressure piston move together;

a high-pressure connection, wherein the high-pressure cylinder is connected to the high pressure connection;

a return connector;

a control valve having a first switching position and a second switching position;

a supply connector;

a first control line connected to the supply connector;

a second control line connected to the control valve;

a first connection connecting the first and second control lines;

wherein the low-pressure cylinder is connected via the control valve in the first switching position to the supply connector and in the second switching position to the return connector;

wherein the first and second switching positions are controlled by a position of the intensifier piston, wherein the intensifier piston opens or closes the first connection between the first control line and the second control line;

wherein the first connection is arranged completely within a movement stroke of the high-pressure piston, and wherein the high-pressure cylinder and the high-pressure piston delimit a high-pressure chamber, wherein the first and second control lines have openings in a wall of the high-pressure cylinder in an area that, independent of a position of the intensifier piston, is located outside of the high-pressure chamber;

wherein a low pressure chamber bounded by the low pressure piston and the low pressure cylinder in the second switching position of the switching valve is connected by a connecting path with a chamber between the high pressure piston and the low pressure piston.

2. The pressure intensifier according to claim 1, wherein the high-pressure piston has a recess overlapping in a predetermined position of the intensifier piston the openings of the first and second control lines, wherein the recess forms the first connection.

3. The pressure intensifier according to claim 2, wherein the recess is an annular chamber.

4. The pressure intensifier according to claim 2, further comprising a seal arrangement comprising a leakage drainage line, wherein the seal arrangement is arranged between the recess and the high-pressure chamber.

5. The pressure intensifier according to claim 1, wherein the control valve is connected to the return connector by a path extending through the low-pressure cylinder in an area between the high-pressure piston and the low-pressure pistons.

6. The pressure intensifier according to claim 1, further comprising a throttled auxiliary control path arranged between the supply connector and a control connector of the control valve, wherein the auxiliary control path switches the control valve into the first switching position.

7. The pressure intensifier according to claim 6, wherein the throttled auxiliary control path is arranged in a valve element of the control valve.

8. The pressure intensifier according to claim 1, wherein the first and second control lines are mounted separate from the high-pressure connection.

9. A pressure intensifier for fluids comprising:

an intensifier piston comprising a high-pressure piston and a low-pressure piston having a greater diameter than the high-pressure piston;

a high-pressure cylinder, wherein the high-pressure piston is moveably arranged in the high-pressure cylinder;

a low-pressure cylinder, wherein the low-pressure piston is moveably arranged in the low-pressure cylinder and wherein the high-pressure piston and the low-pressure piston move together;

a high-pressure connection, wherein the high-pressure cylinder is connected to the high pressure connection;

a return connector;

a control valve having a first switching position and a second switching position;

a supply connector;

a first control line connected to the supply connector;

a second control line connected to the control valve:

a first connection connecting the first and second control lines;

wherein the low-pressure cylinder is connected via the control valve in the first switching position to the supply connector and in the second switching position to the return connector;

wherein the first and second switching positions are controlled by a position of the intensifier piston, wherein the intensifier piston opens or closes the first connection between the first control line and the second control line;

wherein the first connection is arranged completely within a movement stroke of the high-pressure piston, further comprising a second connection between the control valve and the low-pressure cylinder, wherein the low-pressure piston has at least one end face provided with a circumferentially extending recess, wherein the second connection opens at a circumferential wall of the low-pressure cylinder in an area of an end face of the low-pressure cylinder;

wherein a low pressure chamber bounded by the low pressure piston and the low pressure cylinder in the second switching position of the switching valve is connected by a connecting path with a chamber between the high pressure piston and the low pressure piston.

* * * * *